US010687393B2

(12) United States Patent
Lu et al.

(10) Patent No.: US 10,687,393 B2
(45) Date of Patent: Jun. 16, 2020

(54) ONE-COAT ENCAPSULATED GRAPHITE HEATER AND PROCESS

(71) Applicant: Momentive Performance Materials Inc., Waterford, NY (US)

(72) Inventors: Zhong-Hao Lu, Twinsburg, OH (US); Tomoo Hasegawa, Hyogo (JP); Yoshihiko Matsui, Hyogo (JP); Yuji Morikawa, Hyogo (JP)

(73) Assignee: Momentive Performance Materials Inc., Waterford, NY (US)

( * ) Notice: Subject to any disclaimer, the term of this patent is extended or adjusted under 35 U.S.C. 154(b) by 115 days.

(21) Appl. No.: 15/317,286

(22) PCT Filed: Jun. 12, 2015

(86) PCT No.: PCT/US2015/035588

§ 371 (c)(1),
(2) Date: Dec. 8, 2016

(87) PCT Pub. No.: WO2015/192023

PCT Pub. Date: Dec. 17, 2015

(65) Prior Publication Data

US 2017/0127476 A1 May 4, 2017

Related U.S. Application Data

(60) Provisional application No. 62/011,646, filed on Jun. 13, 2014.

(51) Int. Cl.
*H05B 3/20* (2006.01)
*H05B 3/28* (2006.01)
(Continued)

(52) U.S. Cl.
CPC ..... *H05B 3/145* (2013.01); *H01C 17/00* (2013.01); *H05B 3/06* (2013.01); *H05B 3/24* (2013.01);
(Continued)

(58) Field of Classification Search
CPC . H05B 3/145; H05B 3/20; H05B 3/22; H05B 3/28; H05B 3/40; H05B 3/42
See application file for complete search history.

(56) References Cited

U.S. PATENT DOCUMENTS 2,556,679 A 6/1951 Czepek
5,343,022 A 8/1994 Gilbert, Sr. et al.
(Continued)

FOREIGN PATENT DOCUMENTS

JP H06-096844 4/1994
JP H10212181 8/1998
(Continued)

OTHER PUBLICATIONS

ISA / US, International Search Report and Written Opinion, prepared for PCT/US2015/035588, dated Sep. 21, 2015.

*Primary Examiner* — Michael A Laflame, Jr.
(74) *Attorney, Agent, or Firm* — Joseph Waters; McDonald Hopkins LLC

(57) ABSTRACT

A coated graphite heater. The heater has a configuration comprising a plurality of heating elements having a major portion disposed parallel to an upper surface of the heater so that the major portion is disposed horizontally. The heater configuration provides a heater that exhibits reduced thermal stress and/or reduced CTE mismatch stress particularly compared to designs having heating elements with a major portion oriented perpendicular to the plane of the upper surface of the heater.

20 Claims, 9 Drawing Sheets

(51) Int. Cl.

| | |
|---|---|
| ***H05B 3/14*** | (2006.01) |
| ***H05B 3/06*** | (2006.01) |
| ***H05B 3/62*** | (2006.01) |
| ***H05B 3/24*** | (2006.01) |
| ***H01C 17/00*** | (2006.01) |
| ***H05B 3/42*** | (2006.01) |

(52) U.S. Cl.
CPC ..... *H05B 3/42* (2013.01); *H05B 3/62* (2013.01); *H05B 2203/003* (2013.01); *H05B 2203/004* (2013.01)

(56) References Cited

U.S. PATENT DOCUMENTS

| | | | | |
|---|---|---|---|---|
| 6,222,165 | B1 * | 4/2001 | Schwarzkopf ..... | B29C 45/1782 219/468.2 |
| 7,259,358 | B2 | 8/2007 | Mariner et al. | |
| 7,741,584 | B2 | 6/2010 | Mariner | |
| 2008/0173638 | A1 | 7/2008 | Mariner | |
| 2012/0076714 | A1 | 3/2012 | Fahrenbruck | |
| 2012/0318785 | A1 | 12/2012 | Kushihashi et al. | |
| 2013/0269601 | A1 * | 10/2013 | Majima ..... | H05B 3/145 117/217 |

FOREIGN PATENT DOCUMENTS

| | | |
|---|---|---|
| JP | 2013-118088 | 6/2013 |
| WO | 2012177274 | 12/2012 |
| WO | 2015009538 A1 | 1/2015 |

* cited by examiner

ONE-COAT ENCAPSULATED GRAPHITE HEATER AND PROCESS

CROSS-REFERENCE TO RELATED APPLICATION

This application claims priority to PCT Application PCT/US2015/035588, entitled "One-Coat Encapsulated Graphite Heater and Process," filed on Jun. 12, 2015, which claims priority to and the benefit of U.S. Provisional Application No. 62/011,646, entitled "One-Coat Encapsulated Graphite Heater and Process," filed on Jun. 13, 2014, each of which is hereby incorporated by reference in its entirety.

FIELD

The present invention relates to a graphite heater and a process to manufacture the same. In particular, the present invention relates to an encapsulated graphite heater manufactured using a one-coat encapsulation process. The resulting one-coat encapsulated graphite heater configuration is suitable for a wide variety applications including, but not limited to, heating a semiconductor wafer in a semiconductor processing device.

BACKGROUND

In the fabrication of a semiconductor device or semiconductor material, a semiconductor wafer is processed in an enclosure defining a reaction chamber at a relatively high temperature above 1000° C., with the wafer being placed adjacent to or in contact with a resistive heater coupled to a power source. For a cylindrical heater, the wafer can be placed on a support and the support heated by the heater. In this process, the temperature of the semiconductor wafer is held substantially constant and uniform, varying in the range of about 1° C. to 10° C.

U.S. Pat. No. 5,343,022 discloses a heating unit for use in a semiconductor wafer processing process, comprising a heating element of pyrolytic graphite ("PG") superimposed on a pyrolytic boron nitride base. The graphite layer is machined into a spiral or serpentine configuration defining the area to be heated, with two ends connected to a source of external power. The entire heating assembly is then coated with a pyrolytic boron nitride ("pBN") layer. U.S. Pat. No. 6,410,172 discloses a heating element, wafer carrier, or electrostatic chuck comprising a PG element mounted on a pBN substrate, with the entire assembly being subsequently CVD coated with an outer coating of AlN to protect the assembly from chemical attacks.

Although graphite is a refractory material that is economical and temperature resistant, graphite is corroded by some of the wafer processing chemical environments, and it is prone to particle and dust generation. Due to the discontinuous surface of a conventionally machined graphite heater, the power density varies dramatically across the area to be heated. Moreover, a graphite body, particularly after machining into a serpentine geometry, is fragile and its mechanical integrity is poor. Accordingly, even with a relatively large cross sectional thickness, e.g., above about 0.1 inches as typical for semiconductor graphite heater applications, the heater is still extremely weak and must be handled with care. Furthermore, a graphite heater changes dimension over time due to annealing which induces bowing or misalignment, resulting in an electrical short circuit. It is also conventional in semiconductor wafer processing to deposit a film on the semiconductor which may be electrically conductive. Such films may deposit as fugitive coatings on the heater, which can contribute to an electrical short circuit, a change in electrical properties, or induce additional bowing and distortion.

One approach to improving the stability of graphite heaters is to coat the graphite body with a coating layer of a nitride such as boron nitride and a protective overcoat layer typically of the same material as the coating layer. Generally, the graphite body is machined into a desired shape or configuration defining a heating path with heating elements. The path can be, for example, a contiguous path having a space or gaps between adjacent heating elements. To provide a structure with sufficient support for handling and coating, the graphite body is machined to leave graphite bridges between the heating elements. The protective coating, e.g., pyrolytic boron nitride, is applied to the graphite body. Application of the coating layer to the graphite body produces a connecting layer consisting of the coating layer material overlying the graphite bridges. The coated heater body is then machined to remove the graphite bridges from the structure, which would cause the heater to short circuit if left in place. This requires machining through the coating, which leaves areas of exposed graphite. The heater may be machined to leave the connecting layer formed from the coating material.

While this connecting layer may provide support to the graphite heater, the heater must be coated again to coat the areas of exposed graphite. This design might still exhibit high stress from coefficient of thermal expansion (CTE) mismatch stress (between the graphite and boron nitride material) and thermal stress at elevated operating temperatures. High stress can result in early failure in the heating device.

SUMMARY

The present invention provides a one-coat encapsulated graphite heater adapted to relieve thermal stress, CTE mismatch stress, or both such stresses in the heater.

In one aspect, the present invention provides a heater comprising a graphite body comprising at least one heating element configured to form a pattern for an electrical flow path. A structural insert is configured for insertion into the graphite body such that the structural insert provides support for the graphite body, and a coating layer encapsulates the patterned graphite body and the structural insert.

In one embodiment, the structural insert is chosen from a nitride, carbide, carbonitride or oxynitride of elements selected from a group consisting of B, Al, Si, Ga, refractory hard metals, transition metals, and rare earth metals, or complexes and/or combinations thereof. In one embodiment, the structural insert comprises at least one of pyrolytic boron nitride (ON), aluminum nitride, titanium aluminum nitride, titanium nitride, titanium aluminum carbonitride, titanium carbide, silicon carbide, and silicon nitride, or complexes and/or combinations of two or more thereof. In one embodiment, the structural insert comprises pyrolytic boron nitride (pBN).

The present technology also provides a heater according to any of the previous embodiments in which the at least one heating element defines a contiguous path defining a gap between the at least one heating element, and the structural insert is disposed in the gap.

The present technology also provides a heater according to any of the previous embodiments in which a gap between the at least one heating element is defined by a space between a first inner surface of the heating element and a second inner surface of the heating element. The first and second inner surfaces each define a slot and the structural insert is positioned in the slots.

The present technology also provides a heater according to any of the previous embodiments in which the heater includes an outer surface that defines the plane of the heating element, and the structural insert is oriented in the plane of the heating element.

The present technology also provides a heater according to any of the previous embodiments in which the heater includes an outer surface that defines the plane of the heating element, and the structural insert is oriented perpendicular to the plane of the heating element.

The present technology also provides a heater according to any of the previous embodiments in which the heater defines an outer surface, and the structural insert is inserted into a portion of the outer surface of the heater.

The present technology also provides a heater according to any of the previous embodiments that comprises a plurality of structural inserts.

The present technology also provides a heater according to any of the previous embodiments wherein the structural insert includes a locking feature. In one embodiment, the locking feature comprises a structural insert having a dovetail or a key hole shape.

The present technology also provides a heater according to any of the previous embodiments in which the coating comprises a nitride, carbide, carbonitride or oxynitride of elements selected from a group consisting of B, Al, Si, Ga, refractory hard metals, transition metals, and rare earth metals, or complexes and/or combinations of two or more thereof.

The present technology also provides a heater according to any of the previous embodiments in which the structural insert and the coating layer are made of the same material, the material being chosen from a nitride, carbide, carbonitride or oxynitride of elements selected from a group consisting of B, Al, Si, Ga, refractory hard metals, transition metals, and rare earth metals, or complexes and/or combinations thereof.

The present technology also provides a heater according to any of the previous embodiments in which the structural insert and the coating layer each comprise pyrolytic boron nitride (pBN).

In one aspect, the present invention provides a method of forming a heater comprising: providing a graphite body comprising at least one heating element configured to form a pattern for an electrical flow path; inserting a structural insert into the graphite body such that the structural insert provides support for the graphite body; and applying a coating layer encapsulating the patterned graphite body and the structural insert.

In one embodiment, the graphite body defines a contiguous path having a space defined between a first inner surface of the body and a second inner surface of the body and inserting the structural insert comprises inserting the structural insert into the space.

The present technology also provides a method according to any of the previous embodiments in which the first inner surface of the body defines a slot, the second inner surface of the body defines a slot, and inserting the structural insert comprises inserting the structural insert into the slots.

The present technology also provides a method according to any of the previous embodiments in which the at least one heating element defines a longitudinal plane, and the structural insert is inserted in the plane of the longitudinal plane.

The present technology also provides a method according to any of the previous embodiments in which the at least one heating element defines a longitudinal plane, and the structural insert is inserted perpendicular to the longitudinal plane.

The present technology also provides a method according to any of the previous embodiments in which the structural insert is a plate comprising a plurality of pegs on a lower surface thereof, and inserting the structural insert comprises inserting the plurality of pegs into a plurality of corresponding slots in an outer surface of the graphite body.

The present technology also provides a method according to any of the previous embodiments in which the structural insert and the coating independently comprise a material chosen from at least one of a nitride, carbide, carbonitride or oxynitride of elements selected from a group consisting of B, Al, Si, Ga, refractory hard metals, transition metals, and rare earth metals, or complexes and/or combinations of two or more thereof.

The present technology also provides a method according to any of the previous embodiments in which the structural insert and the coating comprise the same material.

The present technology also provides a method according to any of the previous embodiments in which the material of the structural insert has a coefficient of thermal expansion, the material of the coating has a coefficient of thermal expansion, and the coefficient of thermal expansion of the structural insert material is within 40% of the coefficient of thermal expansion of the coating material.

The method provides advantages over conventional heater construction processes that require removal of graphite bridges and multiple coating processes to provide a sufficient coating on the heater body. In particular, the present method and assembly that employs separate insert structures of a ceramic material allows for a single coating operation to be applied to encapsulate the heater body. This can reduce costs and processing of the heaters in terms of time and material costs.

Figure 1A:
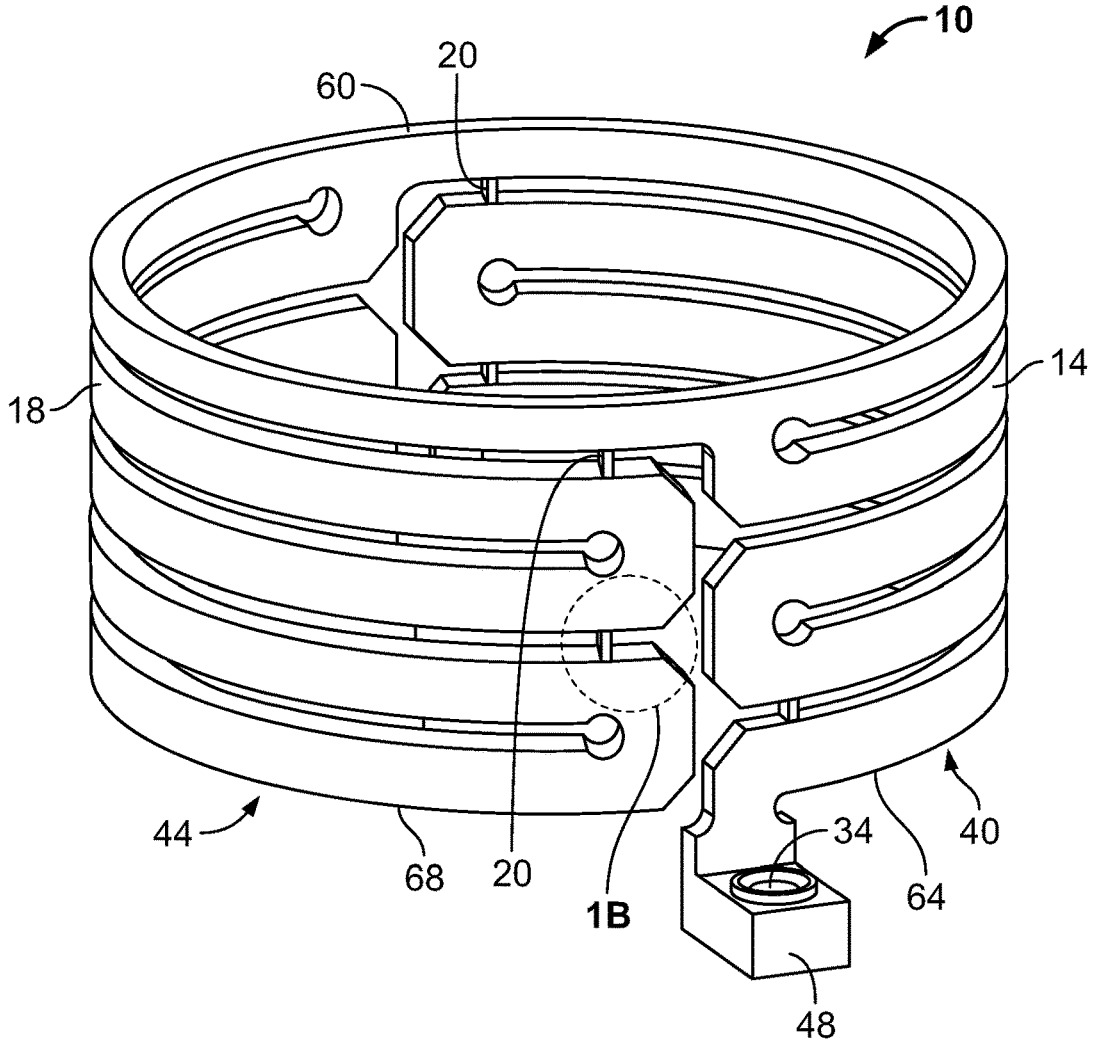
FIG. 1(A) is a perspective view of a cylindrical heater in accordance with an embodiment of the present invention.

The drawings are not to scale unless otherwise noted. The drawings are for the purpose of illustrating aspects and embodiments of the present invention and are not intended to limit the invention to those aspects illustrated therein. Aspects and embodiments of the present invention can be further understood with reference to the following detailed description.

DETAILED DESCRIPTION

The present invention provides a heater comprising a graphite body, a support member, and a coating layer that encapsulates the graphite body and the support member. The support member can be, for example, one or more structural inserts comprised of a nitride, a carbide, a carbonitride, an oxynitride or a combination of two or more thereof, for providing structural support to the graphite body, and the coating layer may comprise a nitride, a carbide, a carbonitride, an oxynitride, or a combination of two or more thereof that encapsulates the graphite body.

The heater comprises a graphite body having a configuration defining a predetermined path defining a plurality of heating elements. The heater can be an integral body where the path can be a continuous path comprising a plurality of heating elements. In one embodiment, the heater comprises a graphite body comprising two halves connected in series, where each half comprises a plurality of heating elements in a predetermined configuration.

In accordance with aspects of the invention, the graphite body comprises a plurality of structural inserts as the support member(s). The locations of the structural inserts are determined based on factors including, but not limited to, the heater design such as the size, shape (e.g., cylindrical vs flat heater), heating path configuration, etc. Any appropriate configuration or number of structural inserts may be selected such that the structural inserts provide adequate support to the graphite body.

FIGS. 1-12 illustrate embodiments in accordance with aspects of the present technology. In FIGS. 1A-6, the heater is illustrated as a cylindrical body comprising an upper surface 60. The heater 10 comprises a first half 40 and a second half 44. The first half extends from a terminal 48, and the second half extends from a terminal 52. Each half, 40 and 44, defines a bottom surface 64 and 68, respectively. Each half of the heater body 10 is machined into a predetermined electrical flow path defining a plurality of heater elements 14 and 18. The terminals 48 and 52 include terminal connecting holes 34 and 56, respectively, which are points of attachment for an electrical power source to provide electrical current to the heater. In one embodiment, the major portion of the heating element 150, 160 (or path) may be oriented parallel with the upper surface of the heater, and a minor portion defining the turn in the path. As illustrated in FIGS. 1-6, the respective serpentine pattern extends linearly and vertically from each terminal and then turns to form the major portions oriented horizontal and parallel to the plane of the upper surface of the heater.

As illustrated, there is a gap or space 22, 26 between successive heating elements. In one embodiment, the gap can be uniform between successive heating elements including at the turn. In another embodiment, the gap defined near the turn of the serpentine path can be provided such that it is sized to have one or more dimensions larger than a dimension of the gap between the major portions of the heating elements. For example, the height or width of the gap near the turn can be larger than the gap between the major portions of the heating elements. As shown in FIGS. 1, 2, 4, and 5, the gap 30 near the turn of the path can be provided with a geometric shape including, but not limited to, a rectangle, a square, a circle, a triangle, a pentagon, a hexagon, a heptagon, etc. The larger gaps 30 can taper or lead to the gap between the heating elements. As illustrated in FIGS. 1, 2, 4, and 5, the gap 30 near the turn of the serpentine path is circular to provide a "keyhole" gap. This design with the relatively large cross sectional area provided by arranging the heating elements with the major portion oriented horizontally to the plane of the upper surface of the heater allows for the inclusion of the larger gap near the turn of the serpentine path. The larger gaps near the turns can further reduce the thermal stress of the heater. Such configurations are described in U.S. Provisional Application 61/846,386, which is incorporated herein by reference in its entirety.

In accordance with aspects of the present technology, the heater body is provided with support members, e.g., structural inserts 20. As show in FIGS. 1A, 1B, and 2, the heater 10 comprises structural inserts 20 disposed in the gap or space 22 and/or 26 defined between heating elements in the path. The heater is provided with slots 24 in a surface of the heating element, and the structural inserts are disposed within the slots. The slots can be formed by any suitable method, e.g., by machining.

Figure 1B:
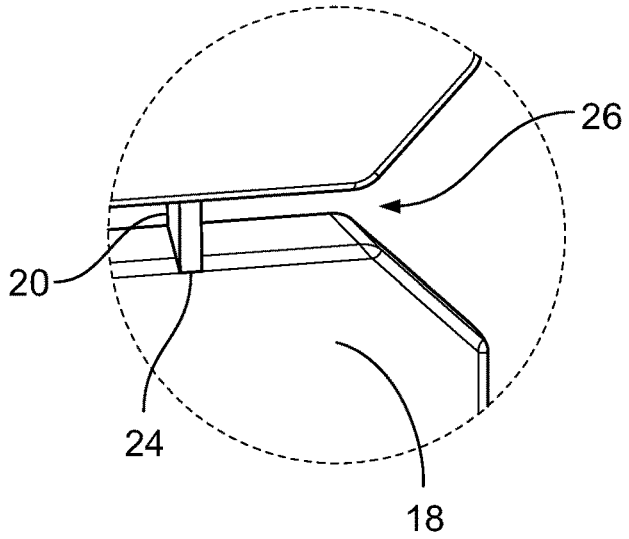
FIG. 1(B) is an enlarged view of a portion of FIG. 1(A)
Figure 2:
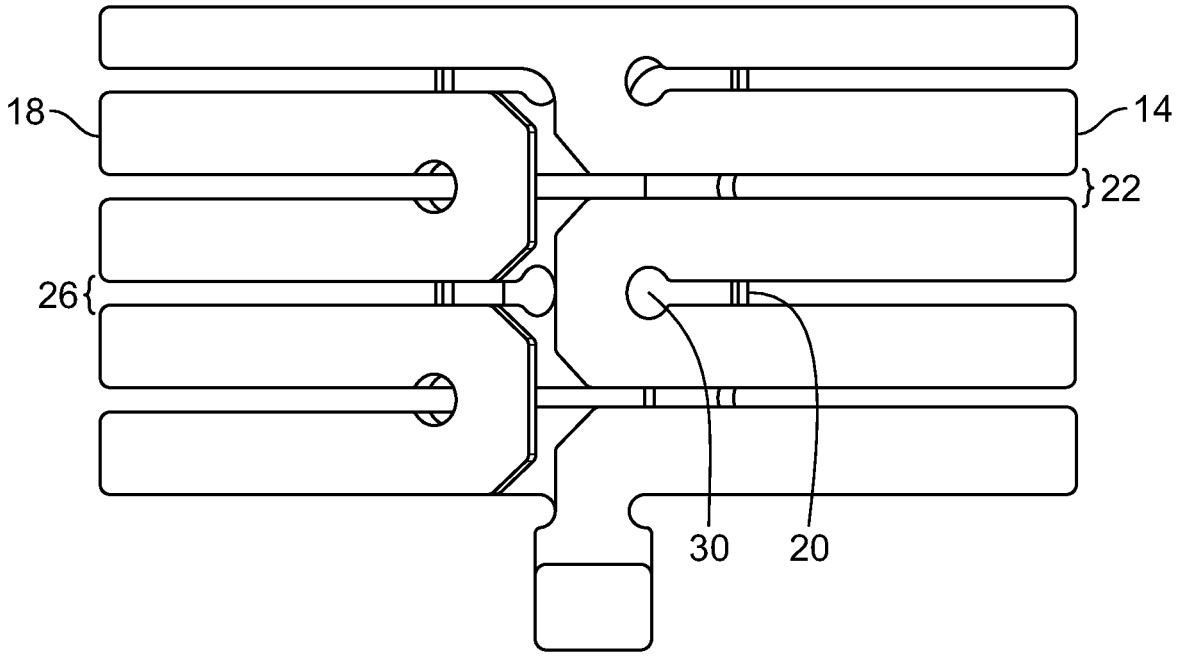
FIG. 2 is a side plan view of the heater of FIG. 1(A)
Figure 3:
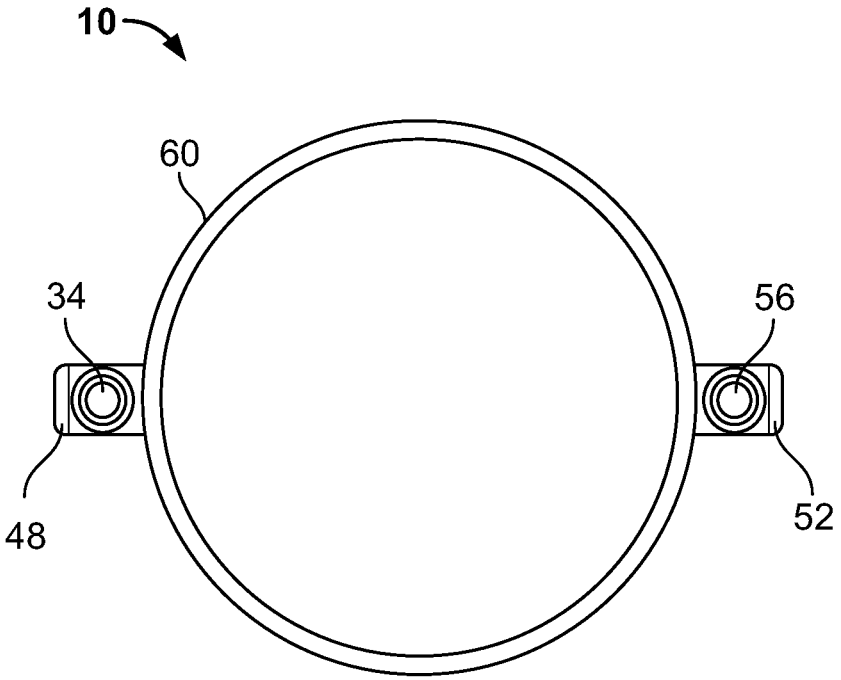
FIG. 3 is a top plan view of the heater of FIG. 1(A)
Figure 4A:
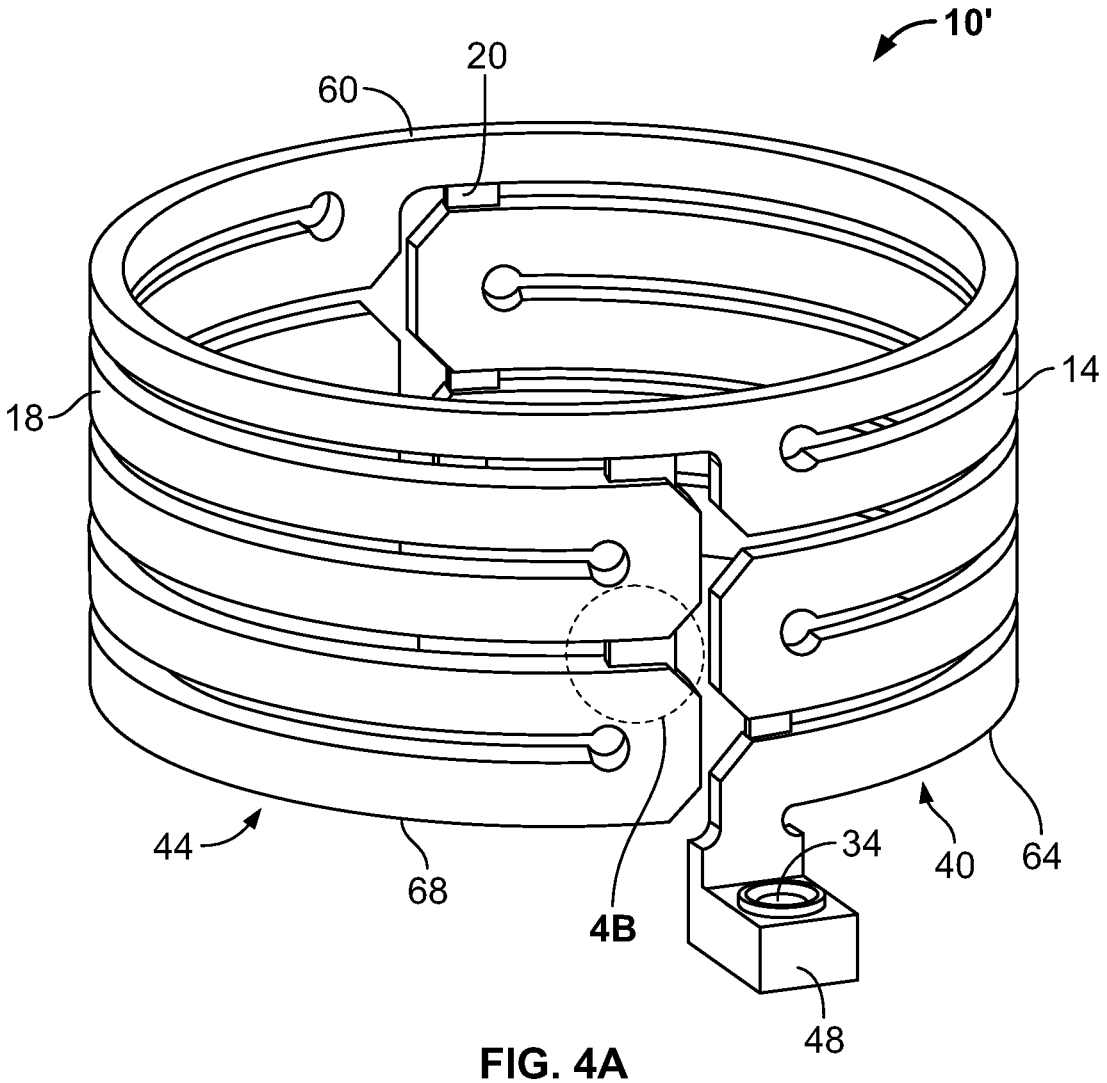
FIG. 4(A) is a perspective view of a cylindrical heater in accordance with another embodiment of the present invention.
Figure 4B:
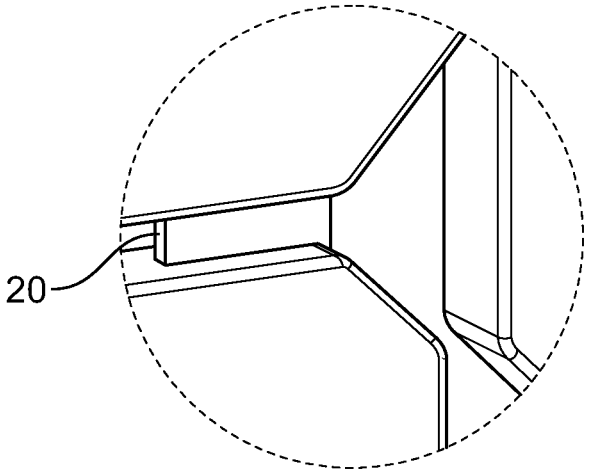
FIG. 4(B) is an enlarged view of a portion of FIG. 4(A)
Figure 5:
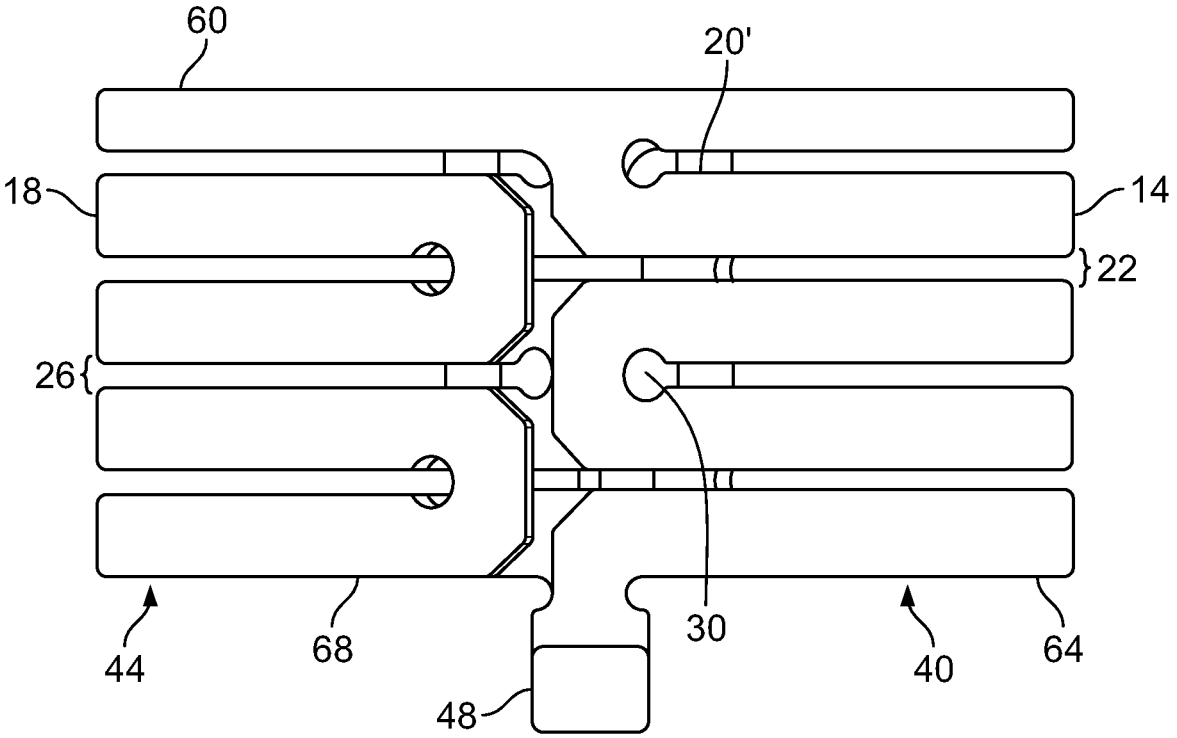
FIG. 5 is a side plan view of the heater of FIG. 4(A)
Figure 6:
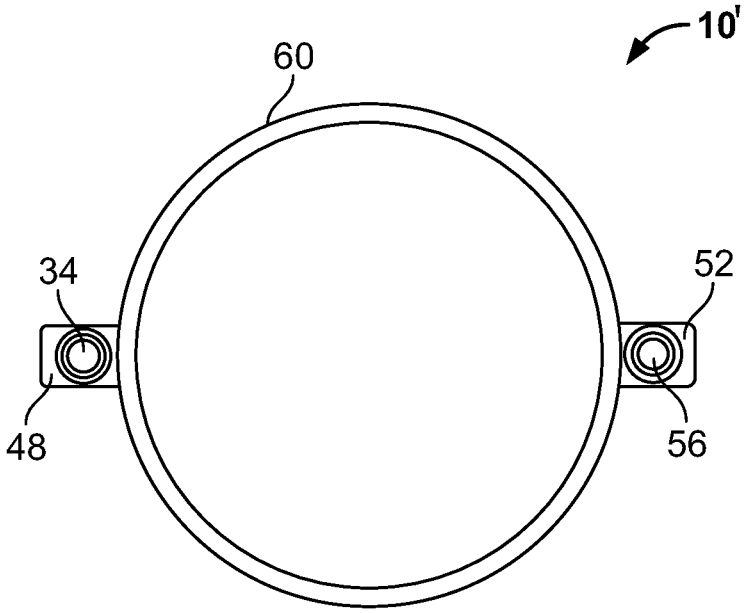
FIG. 6 is a top plan view of the heater of FIG. 4(A)

In FIGS. 1A, 1B, and 2, the structural members are disposed in a direction perpendicular to the path. In FIGS. 4A, 4B, and 5, heater 10' is the same as heater 10 in FIGS. 1-3 except that the inserts 20' are oriented in a direction in-plane with the heating elements 14 and 18.

It will be appreciated that the electrical flow path may form any appropriate pattern, including, but not limited to, a spiral pattern, a serpentine pattern, a helical pattern, a zigzag pattern, a continuous labyrinthine pattern, a spirally coiled pattern, a swirled pattern or a randomly convoluted pattern. Additionally, the heater body can be provided in any suitable shape as desired for a particular purpose or intended application. While the heater in FIGS. 1-6 is shown as cylindrical in shape, the heater can be formed as a polygon of a selected shape, e.g., square, rectangular, etc. Additionally, the path can be configured to provide the heating elements in a stacked orientation (as shown in FIGS. 1-6) or in the same plane to provide a generally flat heater configuration (e.g., FIGS. 7-10).

Figure 7A:
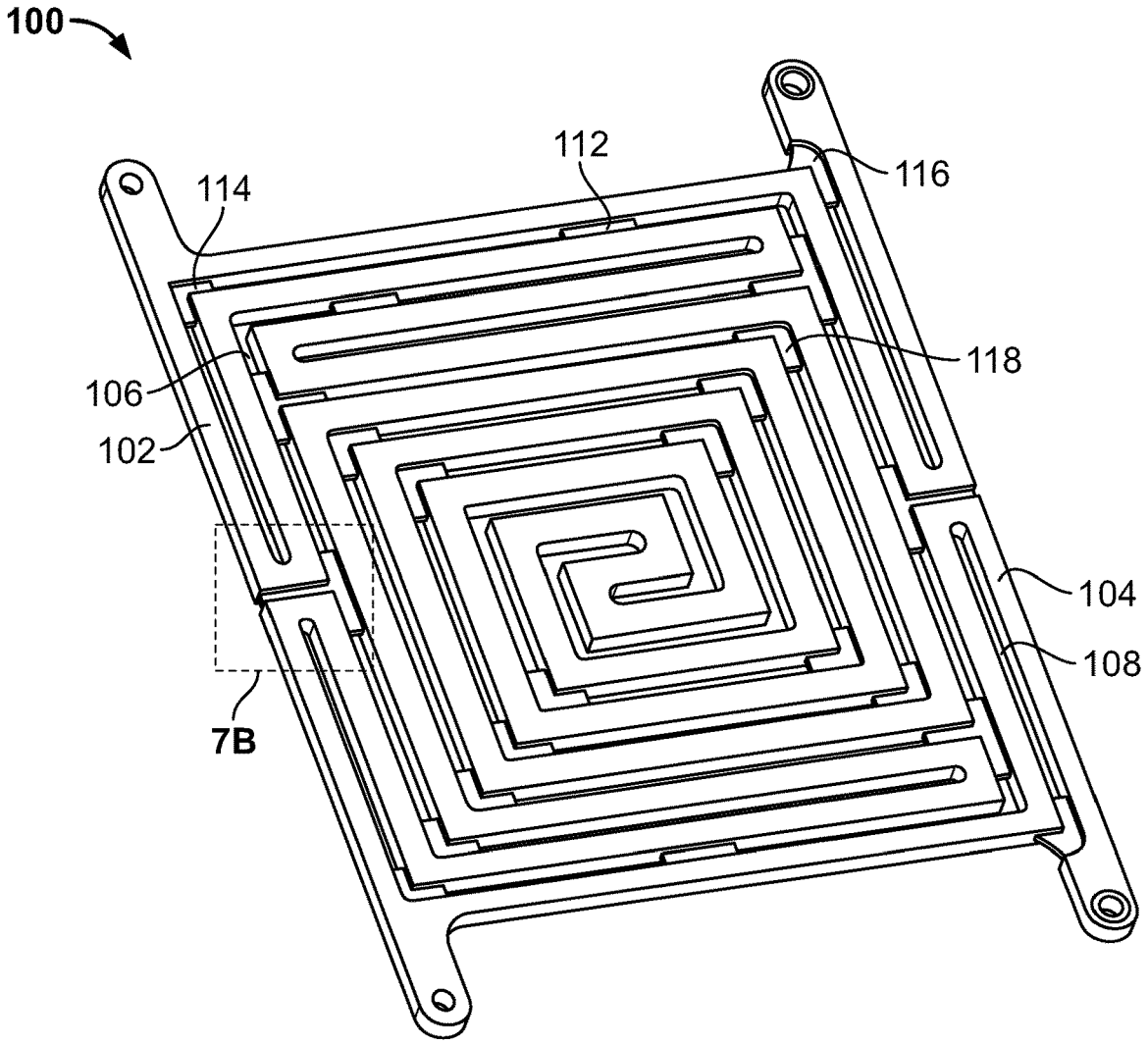
FIG. 7(A) is a perspective view of a flat heater in accordance with another embodiment of the present invention.
Figure 7B:
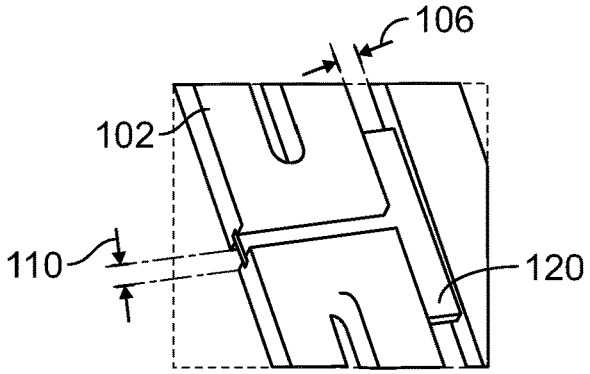
FIG. 7(B) is an enlarged view of a portion of FIG. 7(A)
Figure 8:
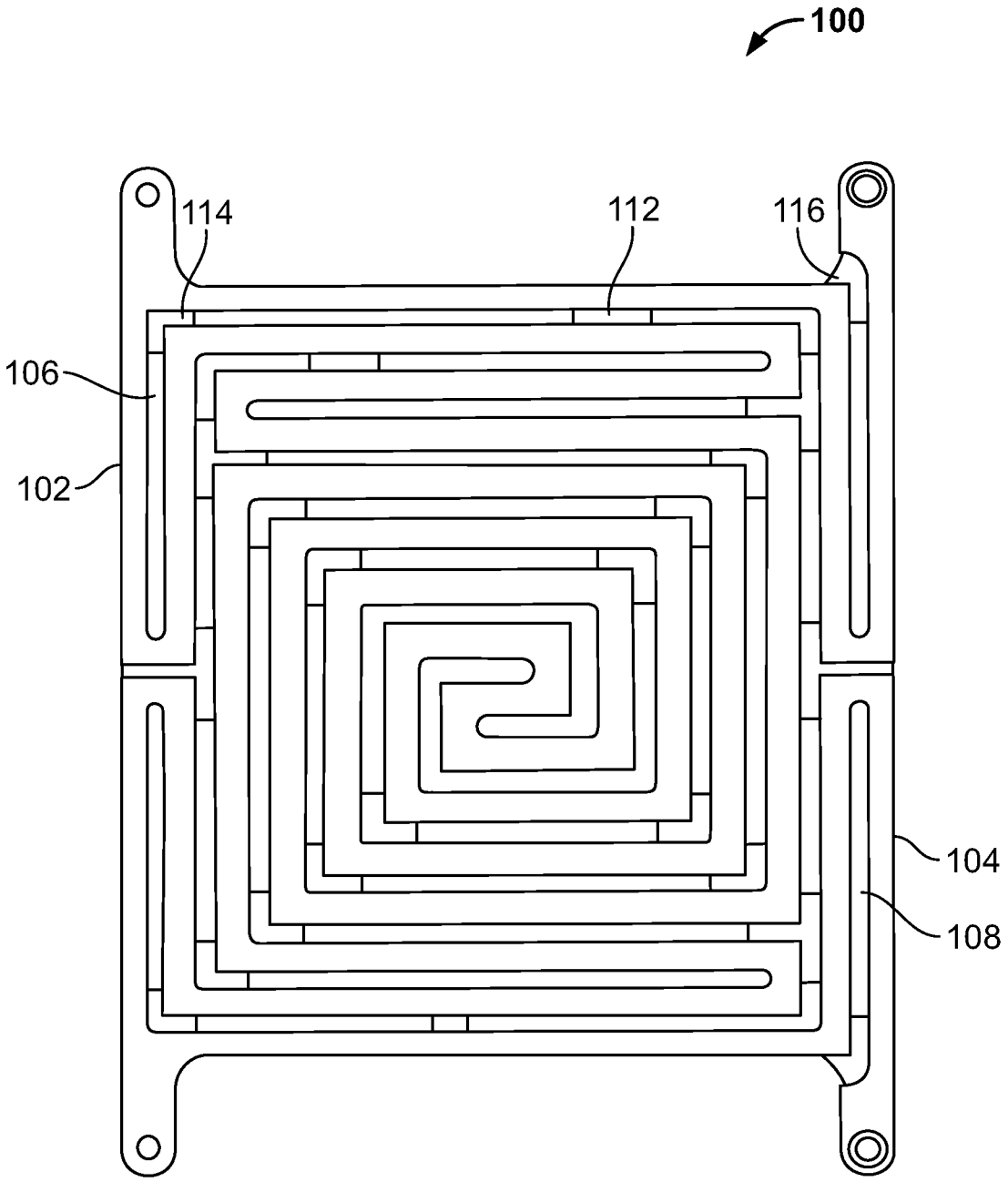
FIG. 8 is a top view of the heater of FIG. 7(A)

FIGS. 7A-10 illustrate a flat heater 100 and 100'. The heaters 100 and 100' comprise heating elements 102 and 104 having spaces or gaps 106, 108, and/or 110, between adjacent heating elements. In FIGS. 7A-8, the heater 100 comprises structural inserts 112, 114, 116, 118, and 120. In FIGS. 7A-8, the inserts are oriented in the plane of the heating elements. Additionally, the structural inserts 112, 114, 116, 118, and 120 are provide with different shapes (e.g., rectangular, L-shaped, T-shaped, or curved) depending on the location where the insert is positioned. As shown in FIG. 11, the structural inserts 124 may be configured to provide a locking feature that prevents the structural insert from being pulled apart from the graphite body. For example, the structural insert may be a "dovetail" shape or a key hole shape. These shapes may keep the structural insert firmly attached to the graphite body and may prevent the structural insert from being pulled apart from the graphite body. Structural inserts with similar or other types of locking features may be used with other heater geometries.

Figure 9A:
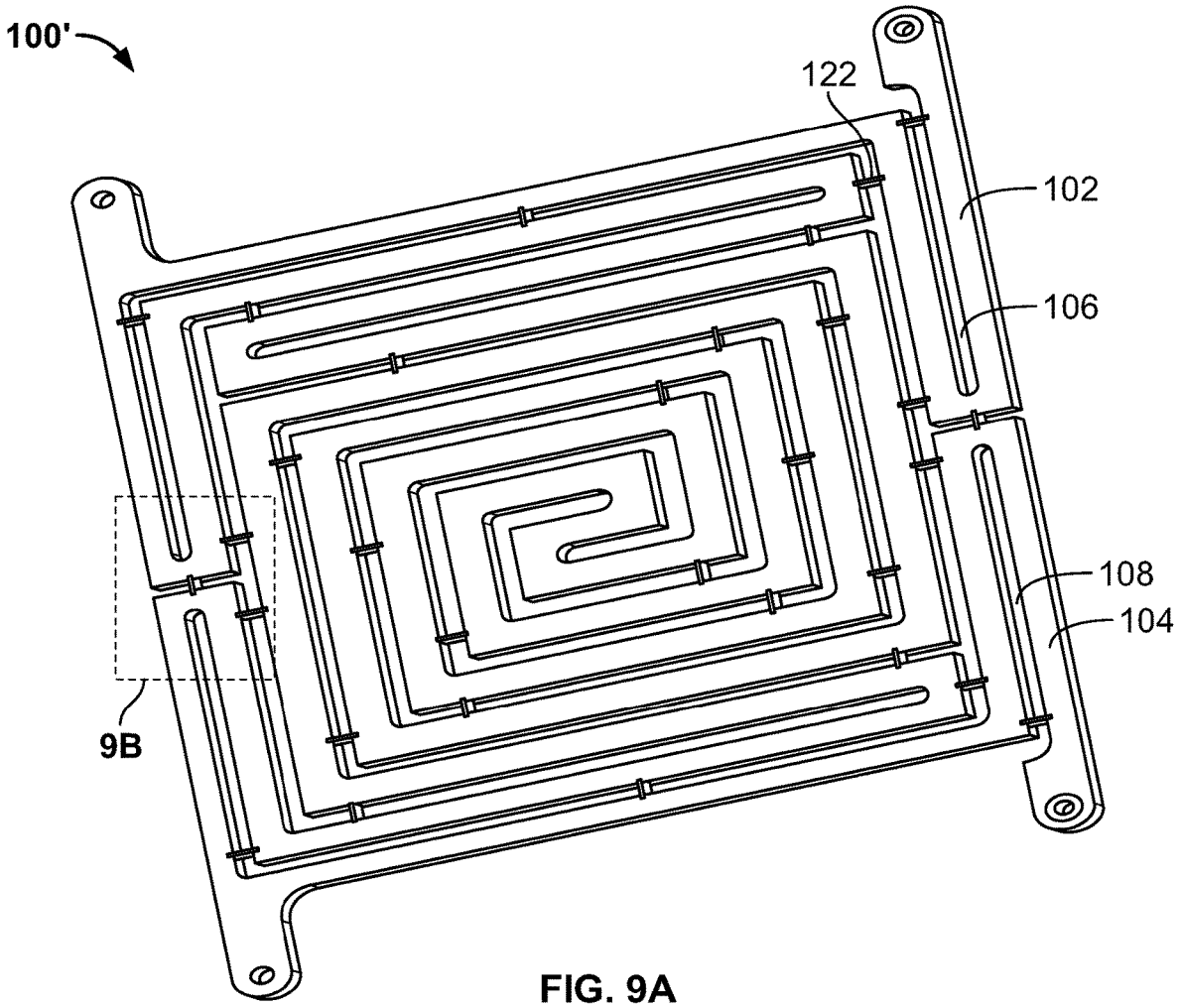
FIG. 9(A) is a perspective view of a flat heater in accordance with another embodiment of the present invention.
Figure 9B:
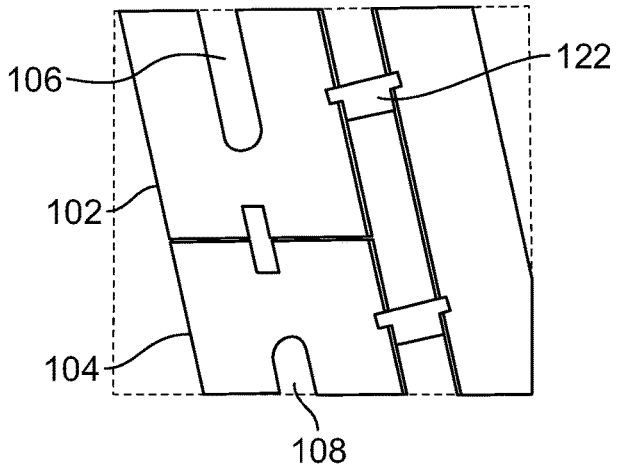
FIG. 9(B) is an enlarged view of a portion of FIG. 9(A)
Figure 10:
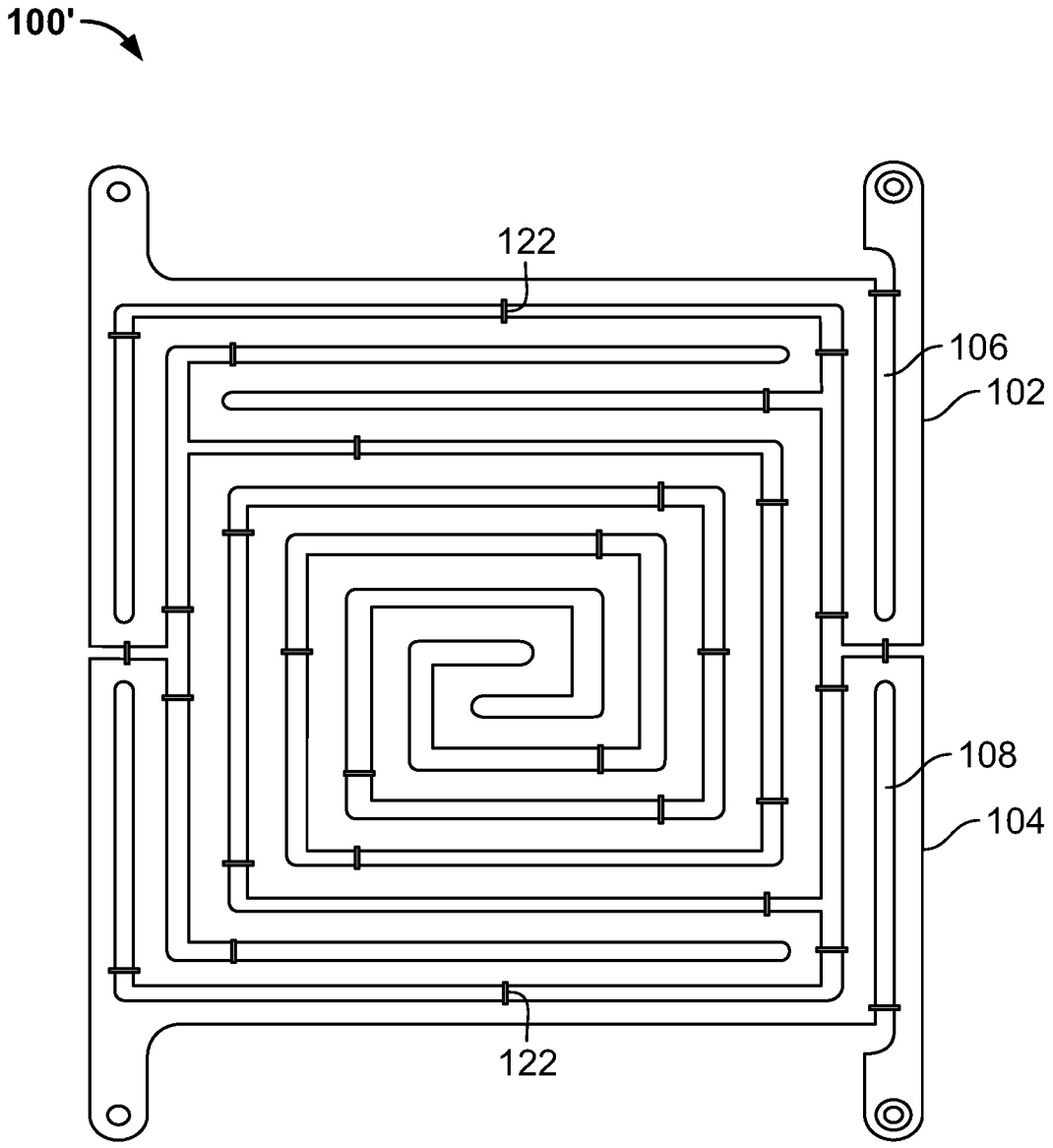
FIG. 10 is a top view of the heater of FIG. 9(A)
Figure 11:
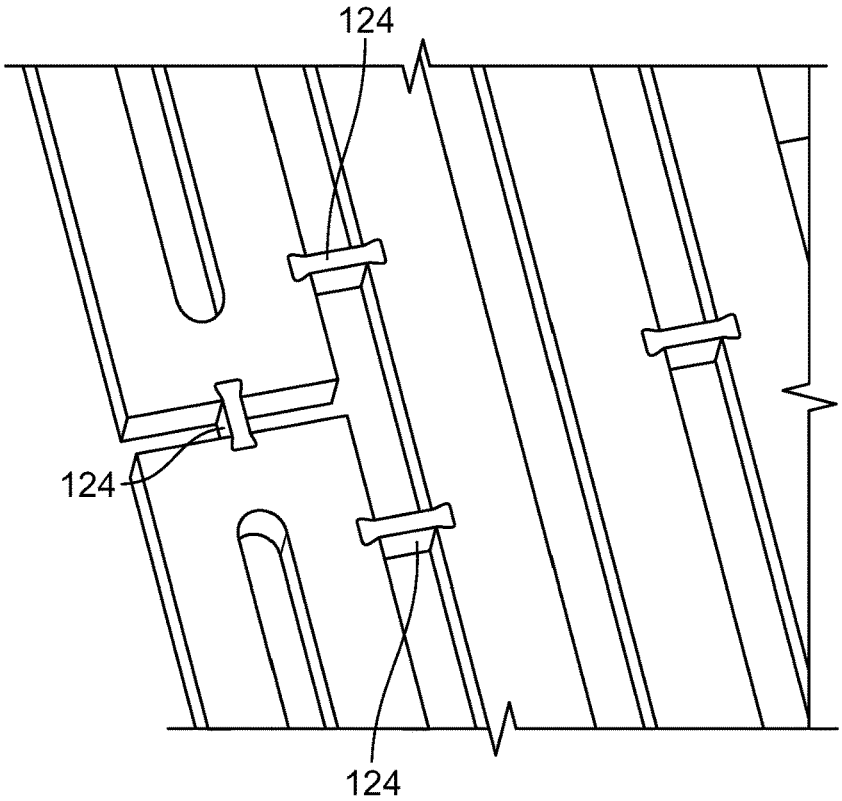
FIG. 11 is a perspective view of a flat heater in accordance with another embodiment of the present invention.

In FIGS. 9A-10, heater 100' is provided that is the same as heater 100 except that heater 100' includes inserts 122 that are oriented perpendicular to the plane of the heating elements 102 and 104. It will be appreciated that the inserts do not have to be oriented in the same direction and that a heater can be provided with a combination of inserts oriented in the in-plane direction and inserts oriented perpendicular to the plane of the heating elements.

Figure 12:
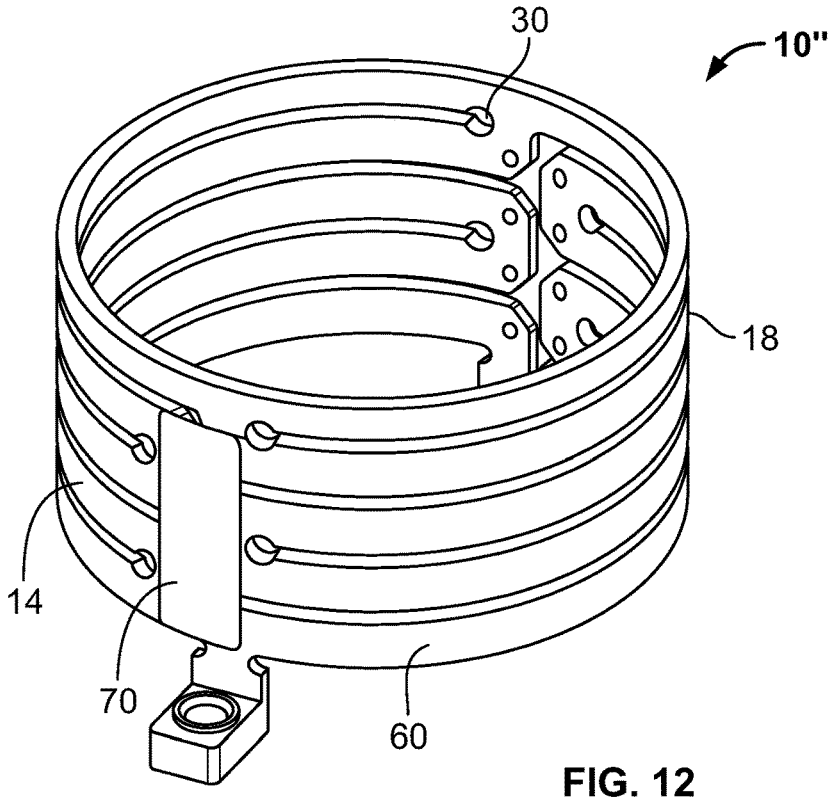
FIG. 12 is a perspective view of a cylindrical heater in accordance with an embodiment of the present invention.

FIGS. 1-11 illustrate structural inserts disposed between the spaces defined by the respective heating elements of the heater body. In another embodiment, the support member can be disposed about an exterior surface of the heater body. FIG. 12 illustrates a heater body 10" that is the same as heater body 10 and 10' except that heater body 10" does not include inserts 20 disposed in the space between heating elements. In FIG. 12, heater body 10" includes a structural support member 70 disposed about the outer surface of the heater body. The support member overlies several heating elements. The support member 70 can be connected to the heater body in any suitable manner. In one embodiment, the support member 70 comprises a plurality of projections (e.g., pegs, stands, etc.) configured to be inserted into corresponding slots or holes disposed on the surface of the heater body's heating elements.

The heater body can be formed of any suitable material as desired for a particular purpose or intended application. As described herein, graphite is particularly suitable for forming the heater body. The particular type of graphite material can be chosen as desired for a particular purpose or intended application. Additionally, the thickness of the graphite form may be determined from electrical calculations on the finished part and dimensional constraints of the heater such as, for example, inner and outer diameter. Fundamental calculations for the finished heater electrical resistance are known in the art, i.e., based on the length, the width, and the thickness of the serpentine electrical path, with the thickness of the electrical path being designed in to the graphite base.

The structural inserts can be formed from any suitable material to provide structural support to the heater body. In one embodiment, the structural inserts comprise one or more of a nitride, carbide, carbonitride or oxynitride of elements selected from a group consisting of B, Al, Si, Ga, refractory hard metals, transition metals, and rare earth metals, or complexes and/or combinations thereof. Examples include pyrolytic boron nitride (pBN), aluminum nitride, titanium aluminum nitride, titanium nitride, titanium aluminum carbonitride, titanium carbide, silicon carbide, and silicon nitride.

In a one embodiment, the structural insert comprises pBN. In a second embodiment, the insert comprises AlN. In a third embodiment, the insert comprises a complex of AlN and BN. In a fourth embodiment, the insert comprises a composition of pyrolytic boron nitride (PBN) and a carbon dopant in an amount of less than about 3 wt % such that its electrical resistivity is smaller than $10^{14}\Omega\bullet$cm. In yet a fifth embodiment, the insert comprises an aluminum nitride wherein a small amount of $Y_2O_3$ is added, e.g. in amount of 5 wt % relative to 100 wt % of aluminum nitride. Both pBN and AlN have excellent insulating and conducting properties and can be easily deposited from the gaseous phase. They also have high temperature stability. Additionally, they have a different color (white) than the pyrolytic graphite base (black) such that in the step of forming the electrical patterns, the coating layer can be easily visually distinguished from the patterns. In still another embodiment the insert can be silicon carbide (SiC). In yet another embodiment, the insert can be a tantalum carbide (TaC).

The structural inserts can be sized and shaped as desired for a particular purpose or intended application. The thickness, size, shape, number, and location of the inserts can be selected to provide sufficient support to the heater. As illustrated in FIGS. 7A-8, for example, inserts of different shapes are employed. The thickness of the inserts is not particularly limited. In one embodiment, the inserts may have a thickness of from about 0.5 mm to about 3 mm. Similarly, the depth of the slots can be selected as desired to provide sufficient support or hold the insert in place. The slots can be relatively shallow or can be relatively deep. The slots can be formed by machining and removing graphite from the heater body.

The structural insert may be inserted into the heater in any appropriate manner. Inserts that are oriented perpendicular to the plane of the heating elements can be directly inserted into the appropriate slots. To insert a structural insert that is oriented in-plane with the plane of the heating element, the graphite heater can be manipulated to expose the slots or allow the insert to be properly positioned.

After the structural inserts have been placed, the graphite body is provided with a substantially continuous coating layer of a sufficient thickness to provide the desired corrosion resistance. This coating layer may also provide additional structural integrity and support in the machining step. In one embodiment, the coating layer encapsulates substantially all the exposed surfaces of the graphite base body and the structural inserts. The coating can also serve to hold the inserts in place. In another embodiment, of the process of the invention, the coating layer simply covers the top or outer surface of the graphite base body for corrosion resistance and structural support.

The coating layer of the graphite body may be of the same material, or of a different material from the structural insert. The coating layer and the structural support may be of different materials. As with the structural insert, the coating layer may comprise at least one of a nitride, carbide, carbonitride or oxynitride of elements selected from a group consisting of B, Al, Si, Ga, refractory hard metals, transition metals, and rare earth metals, or complexes and/or combinations thereof. In one embodiment, the coating layer comprises pBN, AlN, SiC, or SiN. Preferably, when the coating layer and structural support comprise different materials, the coefficient of thermal expansion (CTE) values for the different materials are generally the same. In one embodiment, the CTE of the insert material is within 40% of the CTE of the coating, 20% of the CTE of the coating, within 15% of the CTE of the coating, within 10% of the CTE of the coating, within 5% of the CTE of the coating, even within 1% of the CTE of the coating.

In one embodiment, the coating layer has a thickness of 0.001 to 0.10 inches (about 0.025 mm to about 2.5 mm). In a second embodiment the coating layer has a thickness of 0.003 inches to 0.05 inches (about 0.07 mm to about 1.3 mm). In a third embodiment, this coating layer is about 0.005 inches to 0.03 inches (about 0.12 mm to about 0.8 mm). In yet a fourth embodiment, the coating layer has a thickness of less than about 0.02 inches (about 0.5 mm). In yet a fourth embodiment, the coating layer is a flat solid substantially continuous surface layer of pBN having a thickness in the range of about 0.003 inches to about 0.006 inches (about 0.07 mm to about 0.15 mm).

Different methods can be used to deposit the coating layer onto the graphite body/substrate. In one embodiment, the layer can be applied through physical vapor deposition (PVC), wherein the coating material, e.g. boron nitride and/or aluminum nitride is/are transferred in vacuum into the gaseous phase through purely physical methods and are deposited on the surface to be coated. A number of method variants can be used. In one embodiment, the coating material is deposited onto the surface under high vacuum, wherein it is heated to transition either from the solid via the liquid into the gaseous state or directly from the solid into the gaseous state using electric resistance heating, electron or laser bombardment, electric arc evaporation or the like. Sputtering can also be used, wherein a solid target which consists of the respective coating material is atomized in vacuum by high-energy ions, e.g. inert gas ions, in particular argon ions, with the ion source being e.g. an inert gas plasma. Finally, a target which consists of the respective coating material can also be bombarded with ion beams under vacuum, be transferred into the gaseous phase and be deposited on the surface to be coated.

The above-mentioned PVD methods can also be combined and the coating layer can be deposited e.g. through plasma-supported vapor deposition.

Alternatively in one embodiment of the invention the coating layer can be deposited through chemical vapor deposition (CVD). In contrast to the PVD methods, the CVD method has associated chemical reactions. The gaseous components produced at temperatures of approximately 200 to 2000° C. through thermal, plasma, photon or laser-activated chemical vapor deposition are transferred with an inert carrier gas, e.g., argon, usually at under-pressure, into a reaction chamber in which the chemical reaction takes place. The solid components thereby formed are deposited onto the graphite body to be coated. The volatile reaction products are exhausted along with the carrier gas.

In one embodiment, the graphite body is coated with a layer of pyrolytic boron nitride via a CVD process as described in U.S. Pat. No. 3,152,006, the disclosure of which is herein incorporated by reference. In the process, vapors of ammonia and a gaseous boron halide such as boron trichloride ($BCl_3$) in a suitable ratio are used to form a boron nitride deposit on the surface of the graphite base.

In yet another embodiment, the coating layer can also be deposited using thermal injection methods, e.g. by means of a plasma injection method. Therein, a fixed target is heated and transferred into the gaseous phase by means of a plasma burner through application of a high-frequency electromagnetic field and associated ionization of a gas, e.g., air, oxygen, nitrogen, hydrogen, inert gases etc. The target may consist, e.g. of boron nitride or aluminum nitride and be transferred into the gaseous phase and deposited on the graphite body to be coated in a purely physical fashion. The target can also consist of boron and be deposited as boron nitride on the surface to be coated through reaction with the ionized gas, e.g., nitrogen.

In another embodiment, a thermal spray process is used, i.e., a flame spray technique is used wherein the powder coating feedstock is melted by means of a combustion flame, usually through ignition, of gas mixtures of oxygen and another gas. In another thermal spray process called arc plasma spraying, a DC electric arc creates an ionized gas (a plasma) that is used to spray the molten powdered coating materials in a manner similar to spraying paint. In yet another embodiment, the coating material is applied as a paint/spray and sprayed onto the graphite body with an air sprayer.

In another embodiment for a relatively "thick" coating layer, i.e., of 0.03 inches or thicker, the coating material is applied simply as a liquid paint and then dried at sufficiently high temperatures to dry out the coating. In one embodiment wherein BN is used as a coating, the BN over-coated graphite structure is dried at a temperature of at least 75° C., and in one embodiment, of at least 100° C. to dry out the coating.

In one embodiment after a coating process as described above, the coated graphite structure is heated to a temperature of at least 500° C. to further bond the nitride coating onto the graphite body.

Other coating processes can be used depending on the material being coated. For example, TaC can be deposited by CVR (chemical vapor reaction) methods, whereby the top layer of the graph is converted to the carbide.

Coating the Graphite Body with a Substantially Continuous Coating Layer: In this step, the graphite body is coated for enhanced corrosion resistance against the wafer processing chemical environment. The coating layer may cover both the top and the bottom surfaces of the graphite body, or the coating layer may simply provide a protective layer covering any exposed graphite.

Forming Electrical Contacts. In this final step, electrical contacts are machined through the coating layer to expose the graphite at contact locations for connection to an external power source. Alternatively, electrical contact extensions can be machined into the graphite base at the outset before the coating process.

The heater of the present invention may be used for different applications particularly semiconductor processing applications as a wafer carrier. It has been found that the mechanical strength of the heater of the present invention to be dramatically improved relative to the strength of a conventional graphite heater.

In semiconductor applications, wafers of different size and/or shape are typically processed. Therefore, it will be appreciated that the heater in the broad practice of the present invention may be of any suitable size and shape/conformation, as required for the specific use or application envisioned. The heater may be of a cylindrical shape, a flat disk, a platen, and the like. It may have dimensions of about 2 to 20 inches in its longest dimension (e.g., diameter, length, etc.) and 0.05" to 0.50" inches thick. In one embodiment, it may be of a disk having a dimension of 2" long×2" wide×0.01" mm thick. In one embodiment of a cylinder, the heater has dimensions of 2" to 20" in inside diameter, 0.10" to 0.50" wall, and 2" to 40" long.

All citations referred herein are expressly incorporated herein by reference.

Embodiments of the invention have been described above and modifications and alterations may occur to others upon the reading and understanding of this specification. The claims as follows are intended to include all modifications and alterations insofar as they come within the scope of the claims or the equivalent thereof.

What is claimed is:

1. A heater comprising:

a graphite body comprising at least one heating element configured to form a pattern for an electrical flow path, wherein the at least one heating element defines a contiguous path defining a gap between the at least one heating element, wherein the gap is defined by a space between a first inner surface of the heating element and a second inner surface of the heating element, and wherein the first inner surface has a recessed area defining a first slot and the second inner surface has a recessed area defining a second slot;

a structural insert positioned in the first and second slots; and a coating layer encapsulating the patterned graphite body and the structural insert.

2. The heater of claim 1, wherein the structural insert comprises at least one of a nitride, carbide, carbonitride or oxynitride of elements selected from a group consisting of B, Al, Si, Ga, refractory hard metals, transition metals, and rare earth metals, or complexes and/or combinations of two or more thereof.

3. The heater of claim 2, wherein the structural insert comprises at least one of pyrolytic boron nitride (pBN), aluminum nitride, titanium aluminum nitride, titanium nitride, titanium aluminum carbonitride, titanium carbide, silicon carbide, and silicon nitride, or complexes and/or combinations of two or more thereof.

4. The heater of claim 3, wherein the structural insert comprises pyrolytic boron nitride (pBN).

5. The heater of claim 1 having an outer surface that defines the plane of the heating element, and the structural insert, is oriented in the plane of the heating element.

6. The heater of claim 1 having an outer surface that defines the plane of the heating element, and the structural insert is oriented perpendicular to the plane of the heating element.

7. The heater of claim 1, wherein the heater defines an outer surface, and the structural insert is inserted into a portion of the outer surface of the heater.

8. The heater of claim 1 comprising a plurality of structural inserts.

9. The heater of claim 1 wherein the structural insert includes a locking feature.

10. The heater of claim 9 wherein the locking feature comprises a structural insert having a dovetail or key hole shape.

11. The heater of claim 1, wherein the coating comprises a nitride, carbide, carbonitride or oxynitride of elements selected from a group consisting of B, Al, Si, Ga, refractory hard metals, transition metals, and rare earth metals, or complexes and/or combinations of two or more thereof.

12. The heater of claim 1, wherein the structural insert and the coating layer comprise the same material and wherein the material comprises at least one of a nitride, carbide, carbonitride or oxynitride of elements selected from a group consisting of B, Al, Si, Ga, refractory hard metals, transition metals, and rare earth metals, or complexes and/or combinations of two or more thereof.

13. The heater of claim 12, wherein the structural insert and the coating layer each comprise pyrolytic boron nitride (pBN).

14. A method of forming a heater comprising:

providing a graphite body comprising at least one heating element configured to form a pattern for an electrical flow path, the at least one heating element defining a contiguous path defining a gap between the at least one heating element, wherein the gap is defined by a space between a first inner surface of the heating element and a second inner surface of the heating element, and wherein the first inner surface has a recessed area defining a first slot and the second inner surface has a recessed area defining a second slot;

inserting a structural insert into the first and second slots; and applying a coating layer encapsulating the patterned graphite body and the structural insert.

15. The method of claim 14, wherein the at least one heating element defines a longitudinal plane, and the structural insert is inserted in the plane of the longitudinal plane.

16. The method of claim 14, wherein the at least one heating element defines a longitudinal plane, and the structural insert is inserted perpendicular the longitudinal plane.

17. The method of claim 14, wherein the structural insert is a plate comprising a plurality of pegs on a lower surface thereof, and inserting the structural insert comprises inserting the plurality of pegs into a plurality of corresponding slots in an outer surface of the graphite body.

18. The method of claim 14, wherein the structural insert and the coating independently comprise a material chosen from at least one of a nitride, carbide, carbonitride or oxynitride of elements selected from a group consisting of B, Al, Si, Ga, refractory hard metals, transition metals, and rare earth metals, or complexes and/or combinations of two or more thereof.

19. The method of claim 14, wherein the structural insert and the coating comprise the same material.

20. The method of claim 14, wherein the material of the structural insert has a coefficient of thermal expansion, the material of the coating has a coefficient of thermal expansion, and the coefficient of thermal expansion of the structural insert material is within 40% of the coefficient of thermal expansion of the coating material.

* * * * *